United States Patent [19]

O'Sullivan

[11] Patent Number: 4,829,622

[45] Date of Patent: May 16, 1989

[54] CLEANING DEVICE

[76] Inventor: Sandra L. O'Sullivan, 1528 Old Creek Ct., Cardiff, Calif. 92007

[21] Appl. No.: 155,289

[22] Filed: Feb. 12, 1988

[51] Int. Cl.[4] ..... A47L 13/38

[52] U.S. Cl. ..... 15/209 R; 15/209 D; 15/223; 300/21

[58] Field of Search ..... 15/208, 209 R, 209 B, 15/210 R, 210 A, 211, 223, 225, 228, 230.15, 210.5, 229 AP, 229 BP, 145, 209 C, 209 D; 300/21

[56] References Cited

U.S. PATENT DOCUMENTS

| | | | |
|---|---|---|---|
| 1,716,056 | 4/1929 | Hogaboom | 15/230.15 |
| 2,370,490 | 2/1945 | Rice | 15/230.15 |
| 2,698,504 | 1/1955 | Lotz | 15/223 X |
| 3,434,177 | 3/1969 | Parry | 15/223 X |

*Primary Examiner*—Edward L. Roberts
*Attorney, Agent, or Firm*—Nydegger & Harshman

[57] ABSTRACT

A cleaning device comprises a plurality of layers of thin, flexible, soft nylon netting material superposed over one another in sheets and stitched together along an inner portion of the sheets at a predetermined distance from the outer edge of the sheets. The unconnected outer portions of the sheets remain individually separable thereby allowing the outer portions and edges of the individual sheets to fan out and conform and, therefore, adapt easily to the shape of the surface being cleaned. The device includes a handle which is generally thin and flat, as well as rigid, yet able to bend to get to hard-to-reach places.

19 Claims, 2 Drawing Sheets

CLEANING DEVICE

BACKGROUND OF THE INVENTION

1. Field of the Invention

This invention relates to an improved cleaning device, and, in particular, to an all-purpose cleaning device for scrubbing and cleaning around the home and in commercial settings, which have hard-to-reach areas as well as the more-common surfaces, without scratching.

2. Description of the Prior Art

Conventional cleaning devices as found in the prior art are constructed of many types of materials. These include conventional sponges, cleaning rags, bristle brushes, styrofoam, steel wool, synthetic materials, and the like, used to clean or wash by rubbing or brushing hard.

Unfortunately, such devices are not easily adaptable to a wide range of uses. For example, while some devices are especially good for cleaning flat surfaces, such as pots and pans as used in the home, they are not able to get into crevices and inside corners of different fixtures, such as in kitchens and bathrooms in order to clean such recessed places where dirt and bacteria may collect. There are cleaning devices which are able to reach such small nooks and crevices; and it has been known for people to use small bristle brushes, such as a toothbrush, to clean various narrow crevices, such as the track for shower doors or the narrow space between the faucet handle and flange or base on bathroom and kitchen fixtures. However, such small devices are inefficient for cleaning large, flat surface areas.

Prior art devices have been constructed having two differing materials to handle the differing cleaning requirements, such as one side having a flat sponge surface and another side having heavy, thick, plastic tuft covering. Also, many materials used generate unwanted scratches on the surfaces being cleaned, e.g., steel wool pads.

Other conventional devices utilize brushes having long and short bristles. However, they typically do not have the capability of being flexible since they are usually attached to a rigid backing material, such as wood or plastic, and thus cannot conform nor are easily adaptable to differing shapes encountered in typical cleaning situations. Thus, the toothbrush is often called into action as a last resort to do the job, and yet may still not be satisfactory.

This invention, therefore, provides a new and novel means of providing a cleaning device which permits cleaning in a quick and efficient manner; is thoroughly adaptable to different shapes and sizes of the areas encountered which are to be cleaned; and can be sold at a moderate price.

SUMMARY OF THE INVENTION

It is an object of the present invention to provide an improved cleaning device.

It is another object of the present invention to provide a cleaning device having the property of being easily adaptable to conform to the various surface shapes and narrow crevices encountered when cleaning in the home and in commercial settings, while being capable of cleaning relatively flat areas with the same device at the same time.

It is a further object of the present invention to provide an improved cleaning device which is cheap to manufacture and will make the job of cleaning easier, more efficient, and more effective than is heretofore known in the prior art.

A further object of the present invention is to provide a cleaning device which is simple in construction, economical, and will last for a long time.

It is yet another object of the present invention to provide a cleaning device which is durable and reliable to use.

It is yet another object of the present invention to provide a cleaning device which can be made to fit into many difficult-to-clean areas encountered in the home and in commercial and industrial settings.

Further objects of the present invention will become apparent in the full description of the invention taken in conjunction with the drawings set forth below.

The cleaning device comprises a plurality of layers of thin, flexible, soft netting material superposed over one another in sheets and stitched together along an inner portion of the sheets at a predetermined distance from the outer edge of the sheets. The unconnected outer portions of the sheets remain individually separable thereby allowing the outer edge portions of the individual sheets to fan out and conform and, therefore, adapt easily to the shape of the surface being cleaned. A handle is included which is a generally flat, narrow shape to be inserted into the head comprised of the plurality of layers.

DETAILED DESCRIPTION OF THE DRAWINGS

Figure 1:
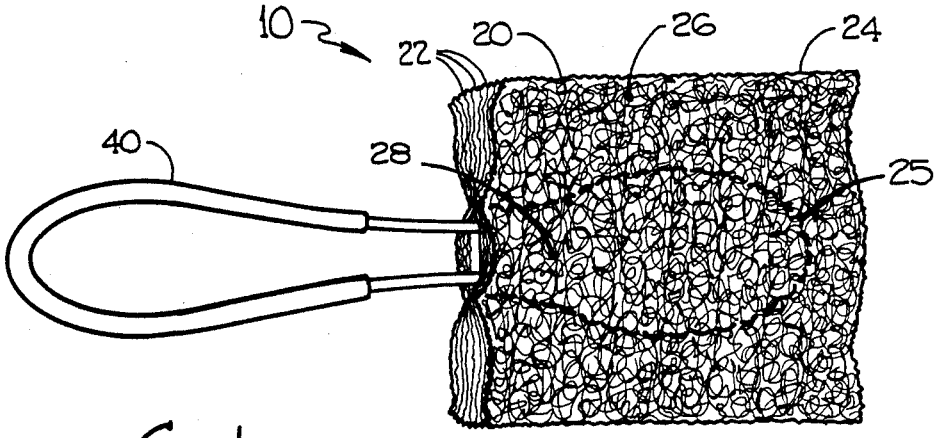
FIG. 1 is a diagrammatic plan view of a preferred embodiment of the cleaning device in accordance with the present invention.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Figure 2:
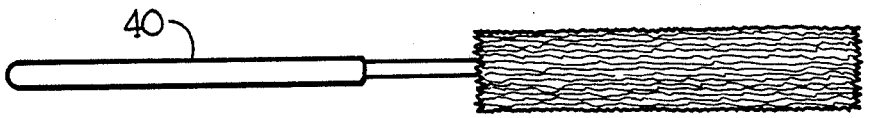
FIG. 2 is a side view of the device shown in FIG. 1.
Figure 3:
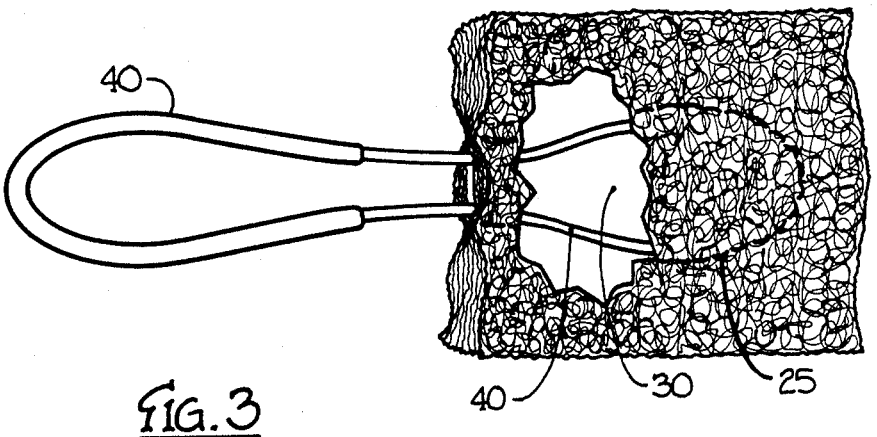
FIG. 3 is a top view of the device shown in FIG. 1.

Referring to the drawings, FIGS. 1 through 3 illustrate a cleaning device in accordance with the present invention. Cleaning device 10 comprises a head 20 and handle 40. The head 20 is comprised of a plurality of layers of thin, flexible material sheets superposed over one another. The sheets are connected together, such as by stitching, along an inner portion 25. Each sheet 22 has an edge portion 24, an outer portion 26, and an inner portion 28.

The material of each sheet 22 comprises a thin, flexible, soft, non-scratching material able to catch and carry away dirt and unwanted deposits. The material which has been found to have preferable qualities for practicing the present invention is nylon netting. However, an equivalent material would also be suitable. It is important that the material be a material which does not cause scratches, such as is often found in conventional devices, but that the material have proper softness, flexibility, and yet sufficient cleaning properties. It is found that nylon netting is, through experimentation, a superior material to be used.

While the sizes of the loops in the netting can be variable, a preferred netting size has holes approximately $\frac{1}{8}$ of an inch in diameter in the netting. Preferable dimensions for the netting are approximately 0.008 inches thick, such that fifty (50) sheets of the nylon netting material, when sown together, is approximately $\frac{3}{8}$ of an inch to 4/100 of an inch thick. A preferable size for the device is approximately $4\frac{1}{2}$ inches wide by 5 inches long. However, variations of convenient sizes would be easily adaptable to the differing purposes for which the cleaning device is put to use. These relative dimensions have been found to be easily adaptable to surface areas typically encountered in the home and in commercial settings with respect to use of this cleaning device.

Figure 5:
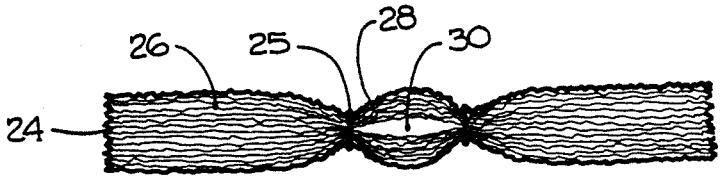
FIG. 5 is an end view along line 5 of the device shown in FIG. 4.

The embodiments shown in FIGS. 2, 3, and 5 show the manner of attaching the sheets together, such as by stitching, thus defining an inner chamber 30, as shown in FIG. 5 and FIG. 3. This allows handle 40, which may be generally flat, narrow, elongated, oval, or other suitable shape, to slide into the chamber 30 formed by the stitched areas 24 in order to easily allow the handle to be inserted into the device. The handle 40 is preferably of a material which is firm and rigid yet able to bend and thus be able to easily adapt to reach various surface areas which need to be cleaned. Inserting the handle 40 into the chamber 30 as defined by the stitched area 24 allows the handle to be easily inserted and removed as required. The handle can be used in its straight shape for areas which are hard to reach with the hand, such as cleaning drinking glasses, and can then be bent to better fit any area which is hard to get to, such as under-toilet rims. It can then be bent back into a straight shape for normal use. The handle also provides a hard surface backing to press against the surface to be cleaned which allows for harder scrubbing. Thus, the method of attaching the sheets together can also serve as a method of allowing the handle to be easily attached to the device.

Moreover, the rigidity of the handle which is adapted to be inserted into the relatively thin, flat shape of the head, makes it possible to reach commonly-overlooked areas.

Also, the handle should preferably be of a material which is resistant to rust, such as zinc coating on steel. In addition, the handle can be covered with plastic, or rubber, or some other material which resists rust, as well as for comfort.

Figure 4:
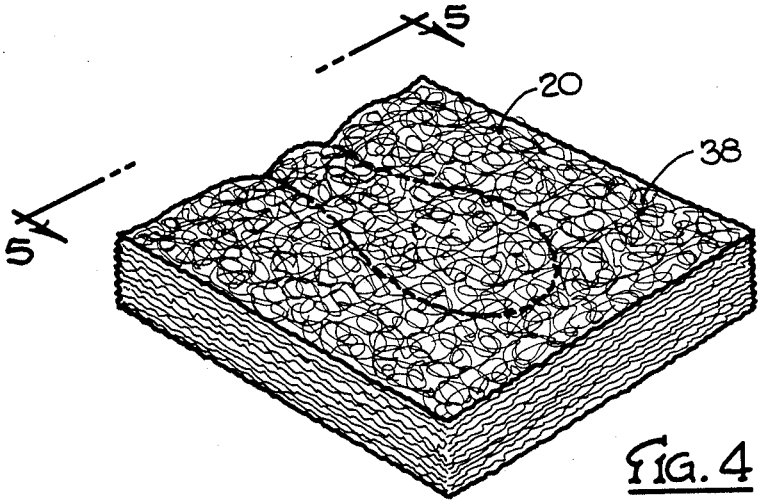
FIG. 4 is a diagrammatic plan view of an alternative embodiment of the cleaning device in accordance with the present invention.

Referring now to FIG. 4, the device is also conveniently utilized without the handle and still realizes benefits of the present invention.

While the present invention contemplates 50 to 65 sheets being utilized, more or less sheets can be used depending on the overall shape of the cleaning device desired and various embodiments could thus be envisioned. Also, for marketing purposes, various colors can be used to color code as to whether the device should be used for bathrooms as opposed to kitchen cleaning. Moreover, depending upon the purpose, the sheets could be cut in shapes different from the rectangle disclosed in the drawings, i.e., circular, oval, triangular, hexagonal, etc.

Figure 6:
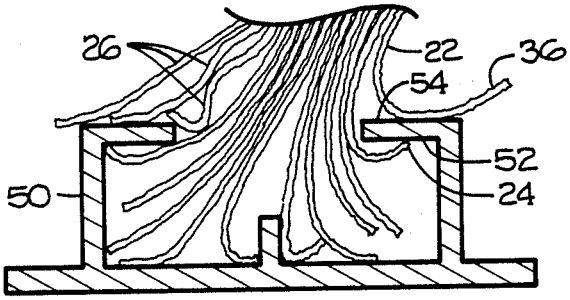
FIG. 6 exemplifies by cutaway end view of the device, the manner in which the cleaning device cleans hard-to-reach places in operation.

In operation, as shown for example in FIG. 6, the individual sheets of netting material, at their outer portions 26, remain individually separable. Therefore, the individual sheets of netting can separate, fan out and thus conform and adapt easily to the various shapes of surfaces to be cleaned. For example, as shown in FIG. 6, the edges 24 can easily reach around behind the areas to be cleaned on object 50, and reach underneath the area 52, which would be extremely difficult to clean with conventional cleaning devices such as steel wool, rags, sponges, or bristle brushes. By using a plurality of thin nylon netting sheets, the individual outer portions and edges of the sheets can engage more surfaces and clean very effectively and quickly.

Figure 7:
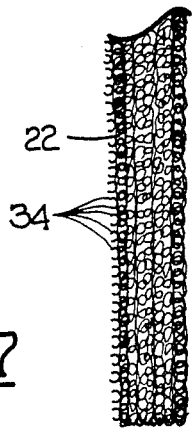
FIG. 7 is a side view close-up of the edge of the material utilized in the present invention.

As shown in FIG. 7, the edges 22 of the netting sheets, upon closer inspection, comprise individual filaments of the nylon netting 34 which have many different ends which stick out along each sheet. Then, the combination of a plurality of thin sheets together provides, at the edges, a number of small, thin, protruding ends which provide scrubbing and cleaning action heretofore unheard of in the prior art. In addition, the individual sheets which are able to spread also provide cleaning areas as shown in FIG. 6, with sheet 36 cleaning the flat open top area 54 of the object 50 to be cleaned.

Thus, it can be seen that the device can be used to clean toilets, all sink fixtures, and tubs and showers, be it tile or fiberglass. The device is able to easily get into and clean all corners of sliding glass tracks and in between doors and the like. This can be accomplished by using the handle or the device can be taken off the handle and put back on at will. The device is fluffy, yet individually the thin characteristics of the nylon netting, the preferred material, provide an easily adaptable and shape-conforming quality of the device.

In addition, the generally flat top or bottom side 38 can be used for cleaning relatively large, flat surfaces also. Thus, the device incorporates the qualities of many different kinds of cleaning devices in one all-purpose cleaning device.

Although the present invention has been shown and described in terms of specific preferred embodiments, it will be appreciated by those skilled in the art, that changes or modifications are possible which do not depart from the inventive concepts described and taught herein. Such changes and modifications are deemed to fall within the purview of these inventive concepts. Thus, it should be noted that the accompanying description and drawings are meant to describe the preferred embodiments of the invention, but are not intended to limit the spirit and scope thereof.

What is claimed is:

1. A cleaning device comprising a plurality of layers of thin, flexible, soft netting material superposed over one another in sheets and connected together along an inner portion of said sheets at a distance from the outer edge of said sheets whereby the unconnected outer portions of said thin sheets remain individually separable, thereby allowing the outer portions and edges of said individual sheets to fan out and conform and thus adapt easily to the shape of the surface being cleaned.

2. The device of claim 1, further comprising a handle, and wherein said inner portion includes means for inserting said handle.

3. The device of claim 2, wherein said sheets are connected together along said inner portion by means of stitching which defines a chamber within the inner portion between said sheets for inserting the handle.

4. The device of claim 3, wherein said handle is generally thin and flat.

5. The device of claim 3, wherein said handle is comprised of a material capable of being bent into various shapes.

6. The device of claim 5, wherein said handle is galvanized wire.

7. The device of claim 5, wherein said wire handle is covered with rubber.

8. The device of claim 1, wherein said material is nylon netting.

9. The device of claim 1, wherein said sheets are in the range of 0.005 to 0.010 inches thick.

10. The device of claim 1, wherein said netting material comprises holes in the netting of approximately in the range of 0.100 to 0.150 inch in diameter.

11. The device of claim 1, wherein said sheets are cut in approximately a rectangular shape.

12. The device of claim 1, wherein the number of sheets are sufficient such that the device has a thickness overall of approximately 1/10 to 1/15 the length.

13. The device of claim 1, wherein said sheets are oval shaped.

14. The device of claim 1, wherein said plurality of sheets comprises between 50 to 65 sheets.

15. The device of claim 1, wherein the material is a specified color to identify different usages of the cleaning device.

16. The cleaning device of claim 1, wherein said netting material is nylon, and said sheets are connected together by stitching.

17. A method of manufacturing a cleaning device comprised of cutting a plurality of thin, flexible, soft, netting material into sheets, superposing said sheets one over the other in layers, stitching said sheets together along an inner portion of said sheets to hold the sheets together, whereby an outer portion of said sheets remain individually separable thereby allowing the edges thereof to fan out and conform to the shape of the surface being cleaned.

18. A cleaning device, comprising: a plurality of layers of thin flexible netting material superposed over one another in sheets and connected together along an inner portion of said sheets at a distance from the outer edge of said sheets whereby the unconnected outer portions of said sheets remain individually separable, thereby allowing the outer portions and edges of said individual sheets to fan out and conform, and thus adapt easily to, the shape of the surface being cleaned;

herein said device is relatively thin and flat, having generally flat top and bottom sides.

19. The cleaning device of claim 18, wherein said sheets are netting material each sheet being in the range of approximately 0.005 to 0.010 inches thick.

* * * * *